United States Patent [19]

Hinata et al.

[11] 4,021,247

[45] May 3, 1977

[54] METHOD OF DISPERSING ORGANIC COMPOUNDS USEFUL IN PHOTOGRAPHY

[75] Inventors: Masanao Hinata; Yuji Mihara, both of Minami-ashigara, Japan

[73] Assignee: Fuji Photo Film Co., Ltd., Minami-ashigara, Japan

[22] Filed: Nov. 13, 1974

[21] Appl. No.: 523,650

[30] Foreign Application Priority Data

Nov. 13, 1973 Japan ..... 48-127521

[52] U.S. Cl. ..... 96/94 R; 96/84 R; 96/87 A; 96/95; 96/107; 96/109; 96/111; 96/114.2; 96/114.4; 96/114.5; 96/126

[51] Int. Cl.[2] ..... E03C 1/02; E03C 1/28

[58] Field of Search ..... 96/100, 109, 95, 97, 96/94, 114.5, 84 R, 87 A, 107, 111, 114.2

[56] References Cited

UNITED STATES PATENTS

| | | | |
|---|---|---|---|
| 2,284,877 | 6/1942 | Martinez | 96/97 |
| 2,322,027 | 6/1943 | Jelley et al. | 96/97 |
| 2,527,268 | 10/1950 | Hart et al. | 96/97 |
| 2,768,958 | 10/1956 | Stewart | 96/109 |
| 3,373,115 | 3/1968 | Steppan | 96/33 |
| 3,421,896 | 1/1969 | Altavilla | 96/94 R |
| 3,466,173 | 9/1969 | Ishikawa et al. | 96/95 |
| 3,482,981 | 12/1969 | Van Lare | 96/106 |
| 3,519,428 | 7/1970 | Ishikawa et al. | 96/95 |
| 3,676,124 | 7/1972 | Ohkubo | 96/100 |
| 3,676,136 | 7/1972 | Mowrey | 96/56 |
| 3,713,833 | 1/1973 | Lindholm | 96/114.1 |
| 3,788,857 | 1/1974 | Van Poucke | 96/100 |
| 3,822,135 | 7/1974 | Sakai | 96/120 |
| 3,963,499 | 6/1976 | Shiba et al. | 96/114.5 |

*Primary Examiner*—Mary F. Kelley
*Attorney, Agent, or Firm*—Sughrue, Rothwell, Mion, Zinn & Macpeak

[57] ABSTRACT

A method for dispersing organic compounds which are substantially insoluble in water and are used in photographic materials, such as chemical sensitizers (except spectral sensitizing dyes), antifoggants, antioxidants, ultraviolet absorbents, color couplers, coating aids, hardening agents, etc., effectively in a silver halide photosensitive emulsion comprising dissolving the organic compounds in an acid having a pKa of not over about 5, such as methanesulfonic acid, ethanesulfonic acid, etc., and adding the solution to the silver halide photosensitive emulsion directly or after dispersing in an aqueous solution.

4 Claims, No Drawings

METHOD OF DISPERSING ORGANIC COMPOUNDS USEFUL IN PHOTOGRAPHY

BACKGROUND OF THE INVENTION

1. FIELD OF THE INVENTION

The present invention relates generally to photography and more particularly it relates to a novel method of adding organic compounds useful in photography to photosensitive emulsions necessary for producing photographic materials.

2. DESCRIPTION OF THE PRIOR ART

Fine silver halide crystals, zinc oxide, cadmium sulfide, fine titanium oxide crystals, etc., are generally known as light-sensitive elements dispersed in photographic emulsions. Also, various compounds are added to each photographic emulsion for various purposes. In particular, photographic compounds for photography added to silver halide photosensitive emulsions include chemical sensitizers, antioxidants, antistatic agents, optical whitening agents, ultraviolet absorbents, plasticizers, development accelerators, color toning agents, supersensitizing dyes, antihalation dyes, filter dyes, antiirradiation dyes, color couplers, coating acids, hardening agents, etc.

The term "organic compounds useful in photography" or "organic compounds useful in photographic materials" as used in this specification means organic compounds other than spectral sensitizing dyes added to photographic materials, for instance, to silver halide photosensitive emulsion layers, intermediate layers, subbing layers, protective layers, filter layers, antihalation layers, etc.

Various methods have been known for adding the organic compounds useful in photography to photosensitive emulsions. For instance, a method in which the organic compound is added as a solution in an organic solvent such as methanol, ethanol, etc., a method in which the organic compound is added as a solution in a mixture of an organic solvent and water, a method in which the organic compound is added as a solution in an aqueous medium such as water, an alkaline aqueous solution, an acid aqueous solution, etc., a method in which, in the case of adding, for instance, a water-insoluble color coupler to a silver halide emulsion, the color coupler is dissolved in a water-immiscible oily solvent and the coupler solution is dispersed in the silver halide emulsion directly or after dispersing the coupler solution in an aqueous gelatin solution together with a dispersing agent, an the like, are known.

However, these known methods have various disadvantages. That is, in the method of adding the organic compound as a solution in a water-miscible organic solvent, when the solubility of the organic compound in the organic solvent is low, a large amount of the organic solvent is required, which results in reducing the surface activity of a coating aid present together in the photographic emulsion, coagulating a binder in the emulsion, and further, in the case of a color photographic material, aggregating other photographic additives such as a coupler, etc., present together with it in the photographic emulsion. Moreover, in such case the difficulties which occur make high speed coating of the photographic emulsion, for instance, coating of the emulsion at a speed of higher than 100 meters per minute very difficult.

On the other hand, the method in which a coupler is dissolved in a water-immiscible oily solvent, the coupler solution is dispersed in an aqueous solution of a hydrophilic colloid together with a dispersing agent, and the dispersion is added to a silver halide emulsion has the disadvantage that when the photographic material prepared by coating the silver halide emulsion containing the dispersion is processed with a photographic processing composition, the evaluation of the emulsion is difficult until the photographic material is dried since the photographic material is opaque in a wet state. Also, since the gelatin layer of the aforesaid photographic material is very soft, precautions are required for the treatment of the photographic material during processing and drying of it.

SUMMARY OF THE INVENTION

An object of this invention is, therefore, to provide an improved method of dispersing effectively the organic compounds useful in photography in a hydrophilic colloid containing a photosensitive material such as silver halide.

It has now been discovered that the aforesaid object of this invention can be quite effectively attained in a method which comprises dissolving the organic compound or compounds useful in photography in an acid having a pKa (in which the Ka is an acid dissociation constant) of not over about 5 (hereinafter the acid having a pKa of not over 5 is simply designated "acid" for brevity), adding the solution to an aqueous solution such as water or an aqueous solution of a hydrophilic colloid to provide a hydrophilic colloid dispersion, and adding the dispersion to a photographic emulsion or adding the solution of the organic compound or compounds in the acid directly to the photographic emulsion.

DETAILED DESCRIPTION OF THE INVENTION

In the present invention the organic compound or compounds useful in photography can be added to a hydrophilic colloid by dissolving the organic compound or compounds in the acid and (1) adding the acid solution to an aqueous solution of the hydrophilic colloid containing a base or (2) adding the acid solution to the aqueous solution of the hydrophilic colloid while neutralizing the system with a base.

The organic compounds useful in photography can be added to a hydrophilic colloid.

In the present invention, by dissolving the organic compounds useful in photography in the acid and then dispersing the solution of the organic compounds useful in photography in a hydrophilic colloid which does not contain photosensitive materials, a novel composition containing particles of the organic compounds useful in photography having a mean diameter of smaller than about 1.0 micron in the hydrophilic colloid is obtained.

The hydrophilic colloid dispersion having dispersed therein the organic compound or compounds useful in photography can be, if desired, subjected to water washing or centrifugal separation to remove the acid, the base or the salt. Also, the hydrophilic colloid dispersion containing the organic compound or compounds useful in photography can be converted into a powder before use by removing all of the solvent therefrom under vacuum or by dehydration.

The organic compounds useful in photography used in this invention include those compounds used a chemical sensitizers, antifoggants, antioxidants, antistatic agents, optical whitening agents, ultraviolet absorbents, plasticizers, development accelerators, color toning agents, supersensitizers, antihalation dyes, filter dyes, anti-irradiation dyes, color couplers, coating aids, hardening agents, and developing agents.

The organic compounds useful in photography can be further described as follows: i) those compounds having a water-solubility of less than about 1% by weight and a solubility of more than about 1% by weight, preferably more than about 5% by weight, in an acid having a pKa not greater than about 5, ii) those compounds which undergo decomposition as determined by dissolving the compound in an acid having a pKa value not greater than about 5 and immediately thereafter neutralizing (pH 6.0 to 8.0) the resulting acidic solution with a base to an extent of less than about 20% by weight, preferably less than 10% by weight.

Examples of the specifically useful organic compounds for photography to which the present application can be applied are triazine ring compounds and pyrimidine ring compounds.

For instance, specific examples of triazine ring compounds which can be effectively used in this invention as the organic compounds useful in photography are the s-triazine ring compounds represented by the following general formula (I) or (II), which are known to be useful supersensitizers for certain sensitizing dyes and also antifoggants in the presence of color couplers as described in U.S. Pat. Nos. 2,933,390; 2,945,762; 2,875,058; 2,950,196; 2,947,630; 3,636,721 and 3,416,927 and British Pat. Nos. 852,074; 852,075; 1,129,117; 1,129,118; 1,187,192; 1,209,755 and 1,210,943:

General Formula: (I)

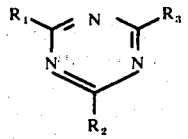

(I)

wherein $R_1$, $R_2$ and $R_3$ each represents a hydrogen atom, a hydroxyl group, an alkoxy group (e.g., a methoxy group, an ethoxy group, etc.), in aryl group (e.g., a phenyl group, a substituted phenyl group, etc.), an aryloxy group (e.g., a phenoxy group, an o-tolyloxy group, a p-sulfophenoxy group, etc.), a halogen atom (e.g., a chlorine atom, a bromine atom, etc.), a heterocyclic group (e.g., a morpholinyl group, a piperidyl group, etc.), an alkylthio group (e.g., a methylthio group, an ethylthio group, a substituted alkylthio group, etc.), an arylthio group (e.g., a phenylthio group, a tolylthio group, etc.), a heterocyclic thio group (e.g., a benzothiazolylthiol group, etc.), an amino group (e.g., an unsubstituted amino group), an alkylamino group (e.g., a methylamino group, an ethylamino group, a propylamino group, a dimethylamino group, a diethylamino group, a dodecylamino group, a cyclohexylamino group, a β-sulfoethylamino group, a β-hydroxyethylamino group, a di-β-hydroxyethylamino group, etc.), an arylamino group (e.g., an anilino group, an o-sulfoanilino group, an m-sulfoanilino group, a p-sulfoanilino group, an o-chloroanilino group, an m-chloroanilino group, a p-chloroanilino group, an o-anisylamino group, an m-anisylamino group, a p-anisylamino group, an o-toluidino group, an m-toluidino group, a p-toluidino group, an o-carboxyanilino group, an m-carboxyanilino group, a p-carboxyanilino group, an o-aminoanilino group, an m-aminoanilino group, a p-aminoanilino group, a p-acetaminoanilino group, etc.), and a heterocyclic amino group (e.g. a 2-benzothiazolylamino group, a 2-pyridylamino group, etc.). The number of carbon atoms for the alkyl moieties in the above groups can range from 1 to 4.

General Formula (II):

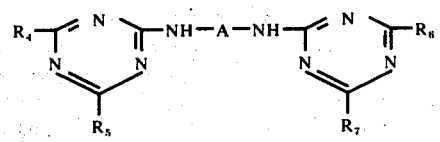

(II)

wherein $R_4$, $R_5$, $R_6$ and $R_7$ each has the same meaning as the groups represented by each of $R_1$, $R_2$, and $R_3$ in General Formula (I) and A represents a divalent aromatic group such as a group comprising one aromatic ring, a group comprising at least two condensed aromatic rings, and a group comprising at least two aromatic rings connected each other directly or through an atom or an atomic group. Specific examples of divalent aromatic groups represented by A are as follows:

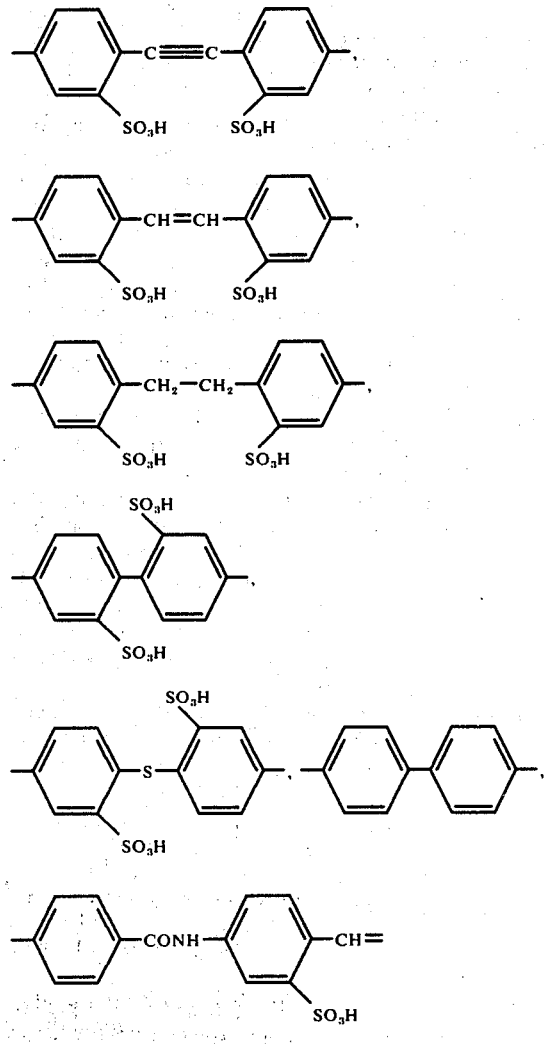

-continued

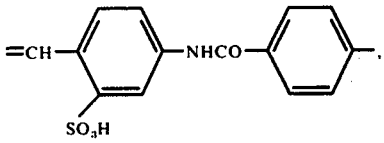

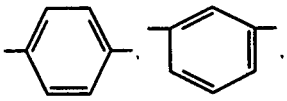

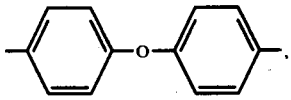

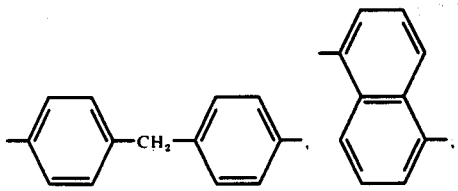

and 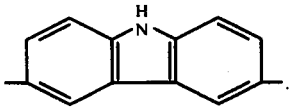

In addition, the sulfo group of group A can be in the form the free acid or a salt such as an alkali metal salt such as the sodium salt or the potassium salt, an ammonium salt, an aliphatic amine salt, e.g., the triethylamine salt, and an aromatic amine salt, e.g., a pyridine salt.

Furthermore, specific examples of pyrimidine ring compounds which can be effectively used in this invention as the organic compounds useful in photography are those represented by the following General Formula (III), the compounds of which are known to be useful as supersensitizers for certain sensitizing dyes or antifoggants for the occurrence of the fog based on sensitizing dyes as described in the specifications of British Pat. Nos. 1,210,943; and 1,209,755; and U.S. Pat. Nos. 3,615,613; 3,635,721; and 3,615,632.

General Formula (III):

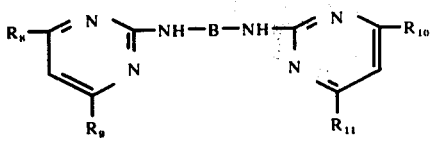

(III)

wherein $R_8$, $R_9$, $R_{10}$, and $R_{11}$ have the same meanings as $R_1$, $R_2$, and $R_3$ in General Formula (I) and B has the same meaning as A in General Formula (II).

Specific examples of organic compounds represented by the aforesaid General Formulae (I), (II) and (III) are illustrated below.

Compound 1

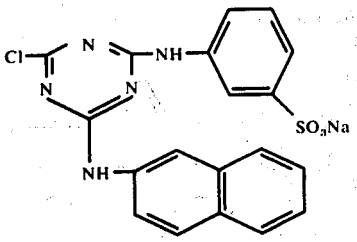

Compound 2

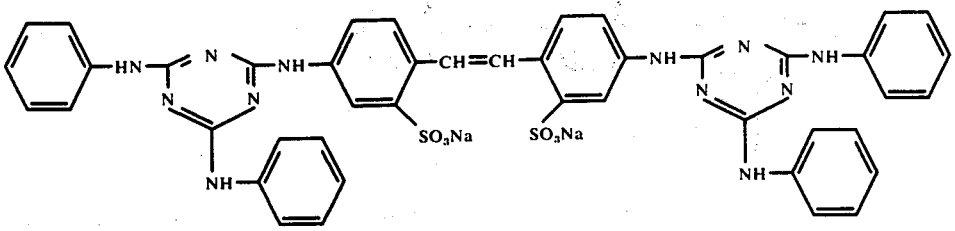

Compound 3

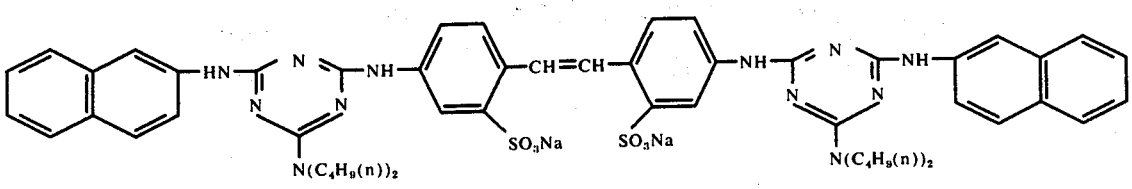

Compound 4
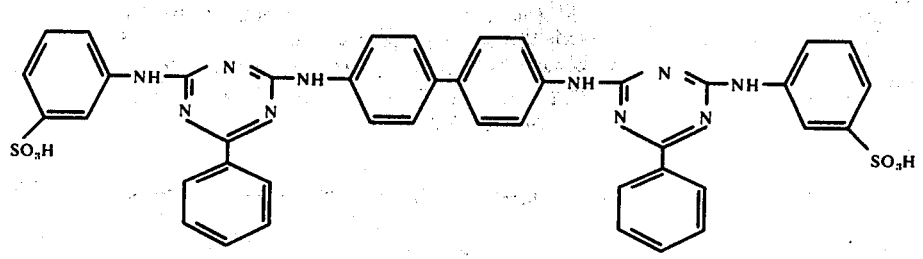
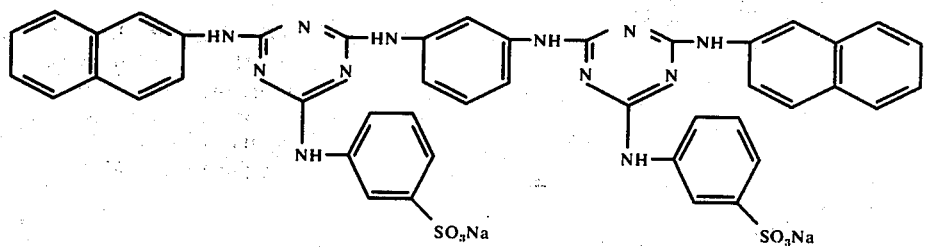
Compound 5
Compound 7
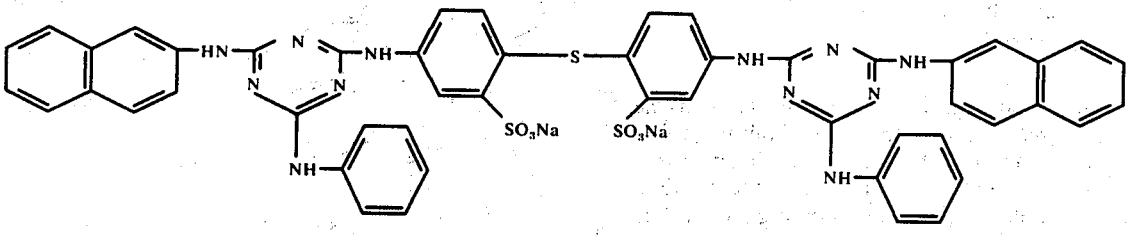
Compound 6
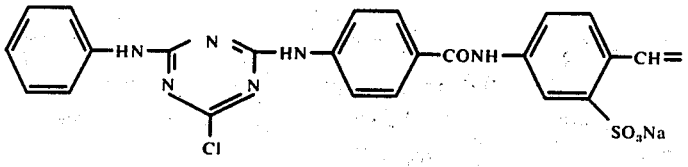
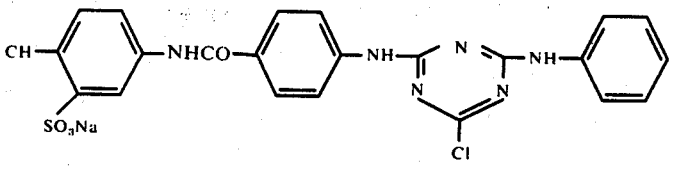
Compound 8
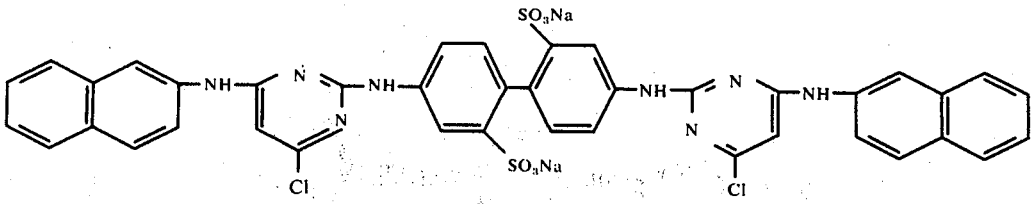

Compound 9

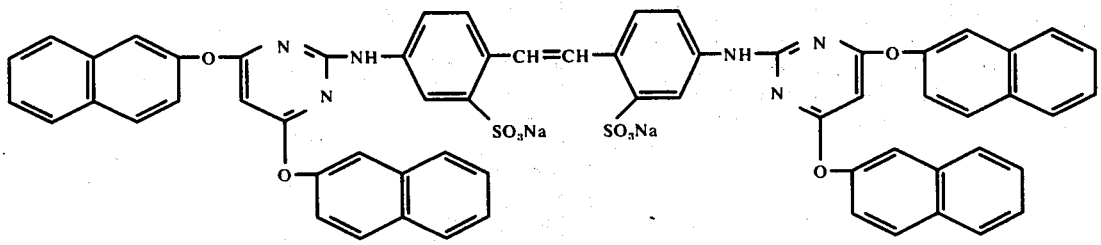

Compound 10

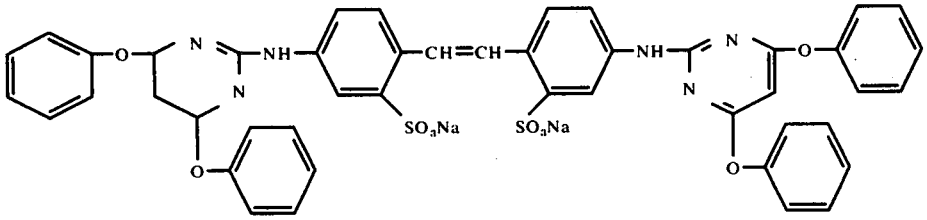

Furthermore, the following known compounds can be also used as the organic compounds useful in photography in this invention:

1. Supersensitizing compounds

Dibenzothiophene dioxides such as, for instance, 3,7-bis(methoxy-3-sulfobenzamido)dibenzothiophene dioxide sodium salt and the compounds as described in U.S. Pat. No. 3,416,927 and in the specifications of British Pat. Nos. 1,129,118; 1,129,117; and 1,312,101; the condensation products of polyhydroxybenzene and formaldehyde such as the condensation product of p-chlorophenol and formaldehyde and the compounds as described in the specifications of U.S. Pat. Nos. 3,650,762 and 3,615,637; thiones such as 1,3-dibenzylbenzimidazole-2-thione and the compounds as described in U.S. Pat. No. 3,669,672; and the non-nitrogen-containing compounds as described in the specification of U.S. Pat. No. 2,937,089, etc., such as, for instance, chrysene, phenanthrene, diphenazine, etc.

2. Chemical sensitizing compounds:

Sulfur compounds capable of forming silver sulfide by reacting with a silver salt, such as the compounds described in the specifications of U.S. Pat. Nos. 1,574,944; 2,410,689; 3,189,458; and 3,501,313; and the amines and other reducing materials as described in the specifications of U.S. Pat. Nos. 2,518,698; 2,521,925; 2,694,637; 2,983,610; 3,201,254; and 3,369,905.

3. Antifoggant or stabilizer compounds:

The benzothiazolium salts and benzoselenazolium salts as described in the specifications of Japanese Pat. No. 21,847/1967 and U.S. Pat. Nos. 2,131,038 and 2,694,716; the nitrobenzimidazoles and the benzimidazoles as described in the specification of British Pat. No. 403,789; the aminonitrobenzimidazoles, nitroindazoles, and aminoindazoles as described in the specifications of U.S. Pat. Nos. 1,696,830; 2,271,229 and 2,324,123; the mercaptotetrazoles and 1-phenyl-2-tetrazoline-5-thiones as described in the specifications of U.S. Pat. Nos. 2,403,927; 2,453,087; 2,465,149 and 2,697,040; the mercaptopyrimidines as described in the specifications of British Pat. No. 452,043; the azaindenes as described in the specifications of British Pat. Nos. 893,428 l and 648,185 and U.S. Pat. Nos. 2,444,605; 2,444,606; and 2,444,607 and also in E. J. Birr, "Azaindolidines as Photochemically Interesting Materials", Z. Wiss. Phot., 47, 2–27 (1952); the mercaptooxadiazoles as described in the specification of U.S. Pat. No. 2,843,491; the mercaptoimidazoles as described in the specifications of U.S. Pat. Nos. 3,252,799 and 2,353,754; the oxazolinethiones as described in the specification of U.S. Pat. No. 3,251,691; the mercaptothiazoles and benzothiazoline-2-thiones as described in the specifications of U.S. Pat. Nos. 2,697,099; 2,759,821; and 2,824,001; the benzoates as described in the specifications of U.S. Pat. Nos. 2,377,375; 3,226,231; and 3,300,312 and British Pat. No. 1,080,425; the benzenesulfinates, benzenethiosulfonates, benzeneselenates, and sulfoxides as described in the specifications of U.S. Pat. Nos. 2,057,764 and 2,394,198; the sulfocatechols and dihydroxynaphthalenesulfonates as described in the specification of U.S. Pat. No. 3,236,652; the urazoles, parabanates, and hydantoins as described in the specifications of U.S. Pat. Nos. 2,708,162 and 3,287,135; the isothiourea derivatives and isothiouronium derivatives as described in the specification of U.S. Pat. No. 3,220,839; the oximes as described in the specification of British Pat. No. 623,448; the mercaptothiadiazoles as described in the specification of U.S. Pat. No. 1,758,576; the glutathiones as described in the specification of U.S. Pat. No. 2,110,178; the aminohydroxypyrimidines as described in the specification of U.S. Pat. No. 2,173,628; the dimercaptooxothiapyran derivatives as described in the specifications of U.S. Pat. Nos. 1,758,576 and 2,214,446; the mercaptotriazine derivatives as described in the specification of U.S. Pat. No. 2,476,536; the poly (N-vinyl-2-pyrrolidones) as described in the specifications of U.S. Pat. Nos. 2,995,444 and 3,052,544; the 1,3-bis(3-amino-1,2,4-triazole-2-yl)-2-propene-1-one derivatives as described in the specification of U.S. Pat. No. 2,444,608; the s-triazine polycondensation products as described in the specification of Japanese Pat. No. 15,471/1971; and the thioanilides, pyrazoles, pyrazolones, secondary and tertiary amines, monoacetyl-aminophenols, diacetylaminophenols chloranils, chloroacetamides, and acetylenic compounds as described in C. E. K. Mees, *The Theory of the*

*Photographic Process*, Revised Edition (1954) and ibid., 3rd Edition (1966) together with the original references cited therein.

4. Color coupler compounds:

The couplers as described in the specifications of U.S. Pat. Nos. 3,311,476; 3,006,759; 3,277,155; 3,214,437; 3,253,924; 2,600,788; 2,801,171; 3,252,924; 2,698,794 and 2,474,293 and British Pat. No. 1,140,898.

5. Antioxidants:

2-Lauroylhydroquinone, 2,5-di-tert-butylhydroquinone, etc.

6. Ultraviolet absorbents:

2,2'-Dihydroxy-4,4'-dimethoxybenzophenone, hydroxyphenylzotriazoles substituted with an aryl group such as a phenyl group, etc.

7. Dyes used as filter dyes, anti-irradiation dyes, and antihalation dyes as well as those used for intermediate layers of multilayer color photographic materials:

Examples of the dyes are the compounds as described in the specifications of U.S. Pat. No. 2,345,193; 3,282,699; and 3,247,127.

In addition to the above-described various organic compounds, other water-soluble compounds used as antistatic agents, optical whitening agents, development accelerators plasticizers, color toning agents, coating aids, or hardening agents can be used in this invention as the organic compounds useful in photography.

It is preferred that the acid used in this invention is substantially water-free or contains less than about 10% by weight, preferably less than 5% by weight, water. It is also advantageous that the acid is soluble in water or more preferably is miscible desirably with water.

Specific examples of the acid can be selected from inorganic acids and organic acids such as aliphatic acids and aromatic acids with organic acids being preferred. For instance, organic acids such as those acids having a sulfo group, acids having a carboxyl group, acids having an enolic hydroxyl group, and acids having two or more of these groups can be employed. Suitable inorganic acids are sulfonic acid, phosphoric acid, etc. Particularly preferred acids are those which are liquid at ambient temperature (about 20 to 30° C) such as, for example, methanesulfonic acid, ethanesulfonic acid, 2-propanesulfonic acid, trifluoromethanesulfonic acid, isethionic acid (2-sulfoethyl alcohol), formic acid, acetic acid, propionic acid, and sulfuric acid.

Furthermore, acids which are solid at normal temperature, such as benzenesulfonic acid, para-benzenedisulfonic acid, para-toluenesulfonic acid, naphthalene-$\alpha$-sulfonic acid, barbituric acid, thiobarbituric acid, methionic acid (methanesulfonic acid), anhydro-2-methyl-5,6-dichloro-1,3-di(2-sulfopropyl)benzimidazole hydroxide, anhydro-2-methyl-5-chloro-1,3-di(3-sulfopropyl)benzimidazole hydroxide, etc., can be used by dissolving these acids in the above-described acids which are liquid at normal temperature or in an organic solvent for the acid such as methanol. Also, the above-described acids which are liquid at normal temperature can be used as a mixture thereof with up to about 50% by volume of an ordinary organic solvent miscible with water, such as methanol, ethanol, acetone, methyl cellosolne, dimethyl sulfoxide, etc.

The acid solution of the organic compound useful in photography used in this invention can be prepared by stirring the mixture under heating or using ultrasonic wave agitation. When the organic compound useful in photography tends to be decomposed, it can be dissolved in the acid at low temperature.

The acid solution of the organic compound useful in photography can be dispersed in an aqueous solution or a photosensitive emulsion by mechanical high-speed stirring, ultrasonic wave agitation, or a combination thereof. In this case a compound capable of improving the dispersibility and/or a compound capable of removing foaming can be added to the system. Examples of dispersibility-improving compounds are surface active agents such as the anionic surface active agents as described in the specifications of U.S. Pat. Nos. 2,739,891; 3,415,649; and 3,220,847, the cationic surface active agents and nonionic surface active agents as described in the specification of U.S. Pat. No. 3,514,293 and the amphoteric surface active agents as described in the specification of U.S. Pat. No. 3,441,413 and 3,133,816.

The hydrophilic colloid used in dispersing the acid solution of the organic compound useful in photography can be the same colloid as used in photographic emulsions, such as gelatin, olyvinylpyrrolidone or copolymers thereof, cellulose derivatives, alginic acid polymers, polyvinyl alcohol and the like, preferably, gelatin and a compound having a hydrophilic group such as a sulfo group and a carboxyl group. Furthermore, depending on the kind or nature of the organic compound useful in photography, the acid solution thereof can be dispersed in water without using a hydrophilic colloid.

The dispersion of the organic compound thus prepared can be added to a photographic light-sensitive emulsion immediately after the preparation of the dispersion or after storage for a long period of time, for instance, for two weeks.

Moreover, the acid solution of the organic compound useful in photography can be added directly to the photographic light-sensitive emulsion without forming an aqueous dispersion of the acid solution.

Also, in this invention an inorganic base or an organic base such as an aliphatic base and an aromatic base, which neutralizes the acid used in this invention effectively and does not adversely influence the photographic emulsion can be used in the dispersion of the acid solution. Suitable examples of the inorganic and organic bases are, for example, alkali metal hydroxides such as sodium or potassium hydroxide, alkali metal carbonates such as sodium or potassium carbonate and the like, and di- or trialkylamines having 1 to about 4 carbon atoms in the alkyl moiety such as diethylamine, triethylamine and the like, and heterocyclic amines such as morpholine. The pH after the neutralization can vary widely in the range which does not adversely affect the photographic materials, e.g., deterioration in fogging, coating property of the photographic emulsions, etc., but preferably ranges from about 5 to 9.

Thus, the present invention makes it possible to add effectively the organic compound or compounds useful in photography subtantially insoluble in water to photographic emulsions.

A photographic emulsion having added thereto the dispersion of the organic compound useful in photography or the acid solution of the organic compound useful in photography according to the method of this invention is superior in photographic properties such as sensitivity and fog to the case where the organic compound is added by a conventional method.

In particular, when the triazine ring compound or the pyrimidine ring compound is used as a supersensitizer for certain sensitizing dyes, excellent photographic properties are obtained.

Since in the present invention the preparation of the dispersion of the hydrophilic colloid can be conducted without using an organic solvent such as methanol, the disadvantages on coating caused by the use of an organic solvent can be eliminated and high-speed coating becomes possible.

Since the method of this invention can be applied to various kinds of organic compounds useful in photography, a dispersion of two or more organic compounds useful in photography can be also prepared using the method of this invention. For instance, using the method of this invention a mixed dispersion of a coupler and mask-forming compound can be prepared and these two compounds can be present at the same ratio throughout the entire photographic emulsion layer.

Since the dispersion prepared by the method of this invention can dissolve the organic compound useful in photography well and thus the amount of the solvent used can be quite small, a colloid dispersion having a high concentration of the organic compound useful in photography can be stored.

The photographic emulsion used in this invention is composed of a hydrophilic colloid having dispersed therein the light-sensitive elements such as fine crystals of a light-sensitive silver halide, titanium oxide, zinc oxide, cadmium sulfide, etc. Examples of light-sensitive siler halides are silver chloride, silver chlorobromide, silver bromide, silver iodobromide, silver iodochlorobromide, and silver iodide. The light-sensitive salt is dispersed or suspended in an aqueous solution of a hydrophilic colloid binder and then the dispersion of the organic compound useful in photography is added to the light-sensitive hydrophilic colloid dispersion or emulsion. Alternatively, the light-sensitive salt such as, for instance, a silver halide can be coated on a support without using a binder, for instance, by vacuum evaporation and then the dispersion of the organic compound useful in photography prepared according to this invention can be applied to the silver halide layer on the support.

The photosensitive emulsion to which the dispersion of this invention can be applied can contain the following compounds which are well known and employed in conventional photographic techniques and materials.

The light-sensitive emulsion used can be that which has not been chemically ripened or can be sensitized using conventional chemical sensitization techniques, such as the gold sensitization as described in the specifications of U.S. Pat. Nos. 2,540,085; 2,597,876; 2,597,915; and 2,399,083; the sensitization with the ions of metals belonging to Group VIII of the Periodic Table; the sulfur sensitization as described in the specifications of U.S. Pat. Nos. 1,574,944; 2,278,947; 2,440,206; 2,410,689; 3,189,458; and 3,415,649; the reduction sensitization as described in the specifications of U.S. Pat. Nos. 2,518,698; 2,419,974 and 2,983,610; and the combination of these sensitizations.

More particularly speaking, chemical sensitizers include sulfur sensitizers such as allylthiocarbamide thiourea, sodium thiosulfate, and cystine; noble metal sensitizers such as potassium chloraurate, aurous thiosulfate, and potassium chloropalladate; and reduction sensitizers such as tin chloride, phenylhydrazine, and reductone. Also, the light-sensitive emulsion can contain the polyoxyethylene derivative as described in the specifications of British Pat. No. 981,470, Japanese Pat. No. 6475/1956, and U.S. Pat. No. 2,716,062, a polyoxypropylene derivative, or a derivative having a quaternary ammonium group.

The light-sensitive emulsion used in this invention can further contain appropriate antifoggants or stabilizers such as the thiazolium salts as described in the specifications of U.S. Pat. Nos. 2,131,038 and 2,694,716; the azaindenes as described in the specifications of U.S. Pat. Nos. 2,886,437 and 2,444,605; the urazoles as described in the specification of U.S. Pat. No. 3,287,135; sulfocatechols as described in the specification of U.S. Pat. Nos. 3,236,652; the oximes as described in the specification of British Pat. No. 623,448; the mercaptotetrazoles, nitrones, and nitroindazoles as described in the specifications of U.S. Pat. Nos. 2,403,927; 3,266,897; and 3,397,987; the polyvalent metal salts as described in the specification of U.S. Pat. No. 2,839,405; the thiouronium salts as described in the specification of U.S. Pat. No. 3,220,839; and the salts of palladium, platinum and gold as described in the specifications of U.S. Pat. Nos. 2,566,263 and 2,597,915.

The light-sensitive emulsion used in this invention can further contain a developing agent such as a hydroquinone, a catechol, an aminophenol, a 3-pyrazolidone, ascorbic acid or a derivative thereof, reductone, a phenylenediamine, and a mixture of these developing agents. The developing agent can be incorporated in a light-sensitive emulsion layer and/or another appropriate layer of the photographic material. The developing agent can be added as a solution in an appropriate solvent or as a dispersion of the developing agent as described in the specifications of U.S. Pat. No. 2,592,368 and French Pat. No. 1,505,778.

Furthermore, the light-sensitive emulsion can contain a coating aid such as saponin, the alkylaryl sulfonates as described in the specification of U.S. Pat. No. 2,600,831, and the amphoteric compounds as described in the specification of U.S. Pat. No. 3,133,816.

The light-sensitive emulsion used can further contain an antistatic agent, a plasticizer, an optical whitening agent, a development accelerator, an aerial fog preventing agent, a color toning agent, etc.

Also, examples of color couplers which can be incorporated in the light-sensitive emulsion are the couplers as described in the specifications of U.S. Pat. Nos. 3,311,476; 3,006,759; 3,277,155; 3,214,437; 3,253,924; 2,600,787; 2,801,171; 3,252,924; 2,698,794; and 2,474,293 and British Pat. No. 1,140,898.

Anti-irradiation dyes which can be incorporated in the light-sensitive emulsions are the compounds as described in the specifications of Japanese Pat. Nos. 20,389/1966, 3504/1968, and 13,168/1968; U.S. Pat. Nos. 2,697,037; 3,423,207; and 2,865,752; and British Pat. Nos. 1,030,392 and 1,100,546.

When a silver halide is used as the light-sensitive salt, an ordinary gelatino silver halide emulsion is used in this invention but the materials which do not adversely influence the light-sensitive silver halide can be used in place of gelatin. Such materials include albumin, agar agar, gum arabic, alginic acid, acylated gelatin (e.g., phthalated gelatin, malonated gelatin, etc.), polyvinyl alcohol, polyvinyl pyrrolidone, polyacrylamide, polystyrene, a cellulose derivative (e.g., hydroethyl cellulose, carboxymethyl cellulose, dextrin, etc.), and water-soluble starch.

The silver halide, which can be the grains of an ordinary size or fine grains, in the photographic emulsion used in this invention can be prepared using conventional techniques such as a single jet method, a double jet method, or a combination of these methods. Effective methods of preparing the silver halide emulsions are described in Trivelli & Smith, *The Photographic Journal*, Vol. 79, 330 ~ 338 (1939), C. E. K. Mees, *The Theory of Photographic Process*, MacMillan Co., and Glafkides, *Photographic Chemistry*, Vol. 1, pages 327 ~ 336, Fountain Press, London, 1958 etc.

The photographic emulsions prepared by the method of this invention can be used for various photographic materials. That is, the photographic emulsions prepared by the method of this invention can be used as black and white silver halide emulsions, silver halide emulsions for positive color photographic materials, silver halide emulsions for color papers, silver halide emulsions for negative color photographic materials, silver halide emulsions for color reversal photographic materials, in which the silver halide emulsions for color photographic materials may contain or may not contain color couplers, silver halide emulsions for photographic materials for making printing plates (e.g., lithographic films), light-sensitive emulsions for photographic materials used for cathode ray tube display, radiation-sensitive emulsions for radiographic materials (in particular, direct photographing materials used together with intensifying screens and indirect photographing materials), light-sensitive materials for the colloid transfer process as described in, for instance, the specification of U.S. Pat. No. 2,716,059, light-sensitive emulsions for the silver salt diffusion transfer process as described in the specifications of U.S. Pat. Nos. 2,353,014; 2,543,181; 3,020,155; and 2,861,885, light-sensitive emulsions for the color diffusion transfer process as described in the specifications of U.S. Pat. No. 3,087,817; 3,185,567; 2,983,606; 3,253,915; 3,227,550; 3,227,551; 3,227,552; 3,415,644; 3,415,645; and 3,415,646, light-sensitive emulsions for the silver dye bleach process as described in Friedman, *History of Color Photography* (particularly Chapter 24), American Photographic Publishers Co. (1944) and *British Journal of Photography*, Vol. III, pages 303 ~ 309, Apr. 7, 1964, light-sensitive emulsions for the imbibition transfer process as described in U.S. Pat. No. 2,882,156, light-sensitive emulsions for recording materials of print out images as described in the specifications of U.S. Pat. No. 2,369,449 and Belgian Pat. No. 704,255, light-sensitive emulsions for direct print image type photographic materials as described in the specifications of U.S. Pat. Nos. 3,033,682 and 3,287,137, light-sensitive emulsions for heat developable light-sensitive materials as described in the specifications of U.S. Pat. Nos. 3,152,904; 3,312,550; and 3,148,122 and British Pat. No. 1,110,046, light-sensitive materials for physically developable photosensitive materials as described in the specifications of British Pat. Nos. 920,277 and 1,131,238, and also light-sensitive emulsions for direct positive photographic materials as described in the specifications of U.S. Pat. Nos. 2,497,875; 2,541,472; 3,367,778; 3,501,309; 3,501,310; 3,505,070; 3,531,290; 3,501,305; 3,501,306; 3,501,307; 3,501,312; 3,510,348; and British Pat. Nos. 1,186,711; 1,186,712; and 1,186,713.

The invention will be described in greater detail by reference to the following examples. Unless othewise indicated herein, all parts, percents, ratios and the like are by weight.

EXAMPLE 1

To 1 kg of a gelatino silver chlorobromide emulsion (AgBr : AgCl = 60 mole % : 40 mole %, gelatin/$AgNO_3$ = 1.5 (weight ratio), 0.86 mole-silver halide per kilogram of emulsion) was added 0.015 g of Sensitizing Dye A (as a methanol solution thereof) as shown below and then 0.100 g of Compound 2 described hereinbefore was added to the silver halide emulsion for supersensitizing the emulsion using the Method (a) or Comparative Method (b) as shown below:

a. To 33.7 g of an aqueous 7% gelatin solution was added 10 ml of an aqueous solution of 10% sodium alkylbenzenesulfonate and then after adding thereto simultaneously 2 ml of a methanesulfonic acid solution of 5% Compound 2 and 3.3 ml of an aqueous sodium hydroxide solution having a concentration of 10 N, the mixture was stirred using a high-speed rotary mixer at about 1,000 r.p.m. to form a dispersion. The dispersion was added to the aforesaid silver halide emulsion so that the content of Compound 2 became 0.100 g.

b. A methanol solution of Compound 2 was added to the aforesaid silver halide emulsion so that the content of Compound 2 became 0.100 g.

Both silver halide emulsions thus mixed with the dispersion and the solution by Methods (a) and (b), respectively, were adjusted to the same pH. Each of the silver halide emulsions was coated on a triacetyl cellulose film support and dried to obtain a photographic film sample. The sample film was exposed to light from a tungsten lamp of 640 lux (corresponding to a color temperature of 2854° K) through a yellow filter SC-50 (made by Fuji Photo Film Co., Ltd.) using an optical wedge, developed in a developer having the following formulation for 6 minutes at 20° C, and after stopping, fixing, and washing, dried.

| Formulation of Developer: | |
|---|---|
| Metol | 2 g |
| Sodium sulfite (anhydrous) | 40 g |
| Hydroquinone | 4 g |
| Sodium Carbonate (monohydrate) | 28 g |
| Potassium Bromide | 1 g |
| Water to make | 1 l |

Then, the density of each sample film was measured using a P-type Densitometer made by Fuji Photo Film Co., Ltd. to determine the minus blue sensitivity and the fog value. The standard point of the optical density for determination of the sensitivity was the point of fog + 0.1. The results obtained are shown in Table 1 as relative values.

TABLE 1

| | Sensitivity | Fog |
|---|---|---|
| Method (a) | 124 | 0.05 |
| Comparison Method (b) | 100 | 0.05 |

As is clear from the results shown in Table 1, the photograhic film prepared according to the Method (a) of this invention had a higher sensitivity than the sample by the Comparison Method (b).

Sensitizing Dye A used in this example had the following formula:

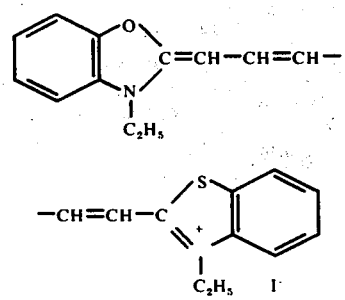

EXAMPLE 2

To 1 kg of a gelatino silver chlorobromide emulsion (AgBr : AgCl = 70 mole% : 30 mole%, gelatin/$AgNO_3$ = 1.5 (weight ratio), 0.86 mole-silver halide per kilogram of the emulsion) was added 0.015 g of Sensitizing Dye B shown below (as a methanol solution) and then 0.100 g of Compound 9 was added thereto by Method (c) or Comparison Method (d) as shown for supersensitizing the silver halide emulsion.

(c) To 33.7 g of an aqueous 7% gelatin solution was added 1.0 ml of an aqueous solution of 10% sodium alkylbenzenesulfonate and after adding simultaneously 2 ml of a methanesulfonic acid solution of 5% Compound 9 and 3.3 ml of an aqueous sodium hydroxide having a concentration of 10 N, the mixture was stirred using a high-speed rotary mixer at about 3,000 r.p.m. to form a dispersion. The dispersion thus prepared was added to the aforesaid silver halide emulsion so that the content of Compound 9 became 0.100 g.

(d) A methanol solution of Compound 9 (having added dropwise thereto a small amount of aqueous sodium hydroxide solution) was added to the aforesaid silver halide emulsion so that the content of Compound 9 became 0.100 g.

Both silver halide emulsions mixed with the dispersion and the solution of Compound 9 according to Method (c) and Method (d), respectively, were adjusted to the same pH value. Each of the silver halide emulsions was coated on a polyethylene-coated paper and dried to obtain a photographic paper sample. The sample was exposed to light from a tungsten lamp of 640 lux (corresponding to a color temperature of 2854° K) through a yellow filter SC-50 (made by Fuji Photo Film Co., Ltd.), using an optical wedge (one second), was developed for 6 minutes at 20° C in a developer having the same formulation as in Example 1, and, after stopping, fixing, and washing, was dried. The density of the sample was measured using a P-type densitometer made by Fuji Photo Film Co., Ltd. to determine the minus blue sensitivity and the fog value. The standard point of the optical density for the determination of the sensitivity was the point of fog + 0.5. The results obtained are shown in Table 2 as relative values.

TABLE 2

| | Sensitivity | Fog |
|---|---|---|
| Method (c) | 136 | 0.05 |
| Comparison Method (d) | 100 | 0.05 |

As is clear from the results shown in the above table, the photographic paper sample prepared according to the Method (c) of this invention had a higher sensitivity than that of the comparison sample prepared according to Comparison Method (d).

Sensitizing Dye B used in this example has the following formula:

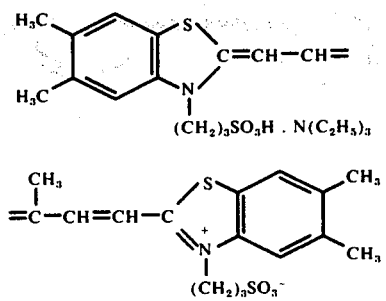

While the invention has been described in detail and with reference to specific embodiments thereof, it will be apparent to one skilled in the art that various changes and modifications can be made therein without departing from the spirit and scope thereof.

What is claimed is:

1. A method for dispersing a compound represented by the formula

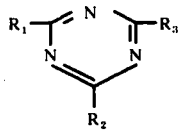

wherein $R_1$, $R_2$ and $R_3$ each represents a hydrogen atom, a hydroxyl group, an alkoxy group, an aryl group, an aryloxy group, a halogen atom, a heterocyclic group, an alkylthio group, an arylthio group, a heterocyclic thio group, an amino group, an alkylamino group, an arylamino group, or a heterocyclic amino group in a silver halide photographic emulsion which comprises (i) preparing a silver halide photographic emulsion, (ii) dissolving said compound in a water-soluble, water-miscible acid selected from the group consisting of methane sulfonic acid and ethane sulfonic acid, said acid containing less than 10% water, (iii) dispersing said solution (ii) in an aqueous solution and then adding said dispersion to said silver halide photographic emulsion, or (iv) adding said solution (ii) directly to said silver halide photographic emulsion.

2. The method of claim 1, in which said organic compound useful in photography is a compound represented by the

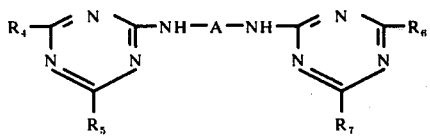

wherein A represents a divalent aromatic group and $R_4$, $R_5$, $R_6$ and $R_7$ each represents a hydrogen atom, a hydroxyl group, an alkoxy group, an aryl group, an aryloxy group, a halogen atom, a heterocyclic group, an alkylthio group, an arylthio group, a heterocyclic thio group, an amino group, an alkylamino group, an arylamino group, or a heterocyclc amino group.

3. The method of claim 1, in which said organic compound useful in photography is a compound represented by the formula

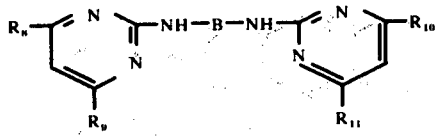

wherein B represents a divalent aromatic group and $R_8$, $R_9$, $R_{10}$ and $R_{11}$ each represents a hydrogen atom, a hydroxyl group, an alkoxy group, an aryl group, an aryloxy group, a halogen atom, a heterocyclic group, an alkylthio group, an arylthio group, a heterocyclic thio group, an amino group, an alkylamino group, an arylamino group, or a heterocyclic amino group.

4. The method of claim 1, wherein said base is an organic or an organic base.

* * * * *